United States Patent [19]

Proellochs

[11] Patent Number: 4,958,279

[45] Date of Patent: Sep. 18, 1990

[54] ASSEMBLY COMPRISING A CASE FIXED ON A SUPPORT

[75] Inventor: Francois Proellochs, Forel, Switzerland

[73] Assignee: Epoque Watch S.A., Switzerland

[21] Appl. No.: 154,948

[22] Filed: Feb. 11, 1988

[30] Foreign Application Priority Data

Feb. 13, 1987 [CH] Switzerland ..... 551/87

[51] Int. Cl.[5] ..... G04B 37/00; A45C 11/10

[52] U.S. Cl. ..... 368/282; 368/276; 224/179

[58] Field of Search ..... 368/276, 281–282, 368/294–296, 299–300; 224/178–179

[56] References Cited

U.S. PATENT DOCUMENTS

| | | | |
|---|---|---|---|
| 1,093,257 | 4/1914 | Becken | 224/179 |
| 1,797,583 | 3/1931 | Miller | 224/178 |
| 2,758,763 | 2/1956 | Cornu | 224/179 |
| 2,791,314 | 2/1940 | Davis | 224/179 |
| 3,480,432 | 11/1969 | Oransky et al. | 430/255 |
| 3,492,809 | 2/1970 | Gisiger-Lusa | 368/299 |
| 3,545,199 | 12/1970 | Rice | 368/14 |
| 3,677,059 | 7/1972 | Miller et al. | 72/403 |
| 4,034,433 | 7/1977 | Slingsby | 15/77 |
| 4,060,185 | 11/1977 | Kuroda | 224/179 |
| 4,081,815 | 3/1978 | Horner | 354/319 |
| 4,101,325 | 7/1978 | Allen | 354/319 |
| 4,277,842 | 7/1981 | Richards | 368/282 |
| 4,334,758 | 6/1982 | Leveille | 354/317 |
| 4,407,850 | 9/1979 | Schneider | 368/282 |
| 4,588,277 | 5/1986 | Buckler | 354/317 |
| 4,742,503 | 5/1988 | Braun et al. | 368/282 |
| 4,759,926 | 7/1988 | Leo | 368/282 |

FOREIGN PATENT DOCUMENTS

| | | | |
|---|---|---|---|
| 1186251 | 1/1965 | Fed. Rep. of Germany | 224/179 |

*Primary Examiner*—Vit W. Miska

*Attorney, Agent, or Firm*—Woodward, Emhardt, Naughton, Moriarty & McNett

[57] ABSTRACT

An assembly comprising a bracelet (1) in special spring steel, adjustable by individual shaping on every wrist, and comprising a circular hole (3) in its flat central part (21). The bracelet is covered with an removable and replaceable elongated sheath consisting of a single piece of elastic fabric. A case is interlocked in the hole (3), the fabric of the sheath being interposed between the case and the bracelet, without damage to the fabric. A tension ring situated in a lateral groove (17) provided on the periphery of the case cooperates with the lower surface of the flat part (12) of the bracelet for the removable fixing of the case on the bracelet.

22 Claims, 3 Drawing Sheets

ASSEMBLY COMPRISING A CASE FIXED ON A SUPPORT

The present invention relates to an assembly comprising a case fixed on a support. According to a preferred embodiment, the case of the assembly contains a watch movement.

The development of clock and watch-making techniques, especially in the sphere of quartz watches, has permitted the costs for the production of watches to be greatly reduced. Thus, concurrently with the market for jewelled watches, which are usually made of gold or another precious metal, generally of great value, a large market has been developed in respect of the secondary watch.

The full importance of indicating the time is preserved by the secondary watch. However, in the same way as with a scarf, a tie or a hand-bag, it has become usual to own several watches, which are matched to the clothing which is being worn, or which are adapted to the activity at the time. In particular, the watches of which the bracelets may be easily changed constitute an easy means of adaptation.

A watch designed so as to permit a bracelet to be changed is described in the European Patent Application published under No. 0198801. This patent application describes an assembly comprising a flat case fixed on a textile material or a thin synthetic or natural material. For this purpose, the textile or the thin material comprises a ring crimped on the circumference of a hole formed beforehand in the textile material at a predetermined position, the case having a circular base introduced into the ring and substantially of the same thickness as the latter. The case and the ring comprise retaining means which cooperate to assure a detachable fixing of the case on the textile.

The watch which is obtained with the aid of the assembly which is described in European Patent Application No. 0198801 well satisfies the function of the secondary or accessory watch as mentioned above. Actually, the variety of textiles or synthetic materials serving as a bracelet on which the watch case can be fixed are numerous and varied. However, the costs of manufacturing such bracelets is relatively high, since it is necessary to crimp a ring on the circumference of a hole previously formed in the textile or other material constituting the bracelet. This cost is all the higher when the said crimping has to be carried out on an elastic material.

The object of the invention is to propose an assembly which permits the detachable fixing of a case, particularly a watch case, on a support, which permits the aforesaid disadvantages to be overcome.

To this end, the invention is concerned with an assembly comprising a case fixed on a support, in which the case and the support comprise a holding means which cooperate in order to assure a detachable fixing of the case on the support, the said holding means being so arranged as to permit the interposition of a fabric or a thin synthetic or natural material between the case and the support.

In accordance with a first embodiment, the support is provided in the form of a rigid bracelet, having a flat part comprising an opening in which the case is fixed.

The bracelet may be covered with a removable sheath of elastic fabric It may be formed of a deformable material, such as, for example, a particularly resilient steel, permitting an adjustement to the wrist without closure. The bracelet may comprise a ring element spot-welded under the flat part of the bracelet.

In accordance with a second embodiment of the assembly, the support is provided in the form of an annular element. The assembly may be carried out on a clothing element. It may also be carried out on an elastic fabric, comprising a zone of smaller thickness at the position for the fixing of the case on the annular element.

The holding means for the case on the support may comprise a wire spring element of steel or of plastic or synthetic material disposed in a groove on the periphery of the case and of which the external diameter, in the rest position, is substantially greater that the internal diameter of the opening in the support, so as to be retained against the lower face of the support after the case has been embedded by pressure in the support opening. The wire spring element may be replaced by a tension ring of steel or plastic or synthetic material, disposed in a groove provided on the periphery of the case at the level of the winder button, and of which the diameter, in the rest position, is substantially greater than the internal diameter of the opening of the support, so as to be held against the lower face of the support after the case has been embedded by pressure in the opening of the support, the tension ring comprising a slot, the edges of which are situated on either side of the winder.

The case may be of plastic material and comprise a lower part and an upper part, the upper part forming the glass and the lower part forming the body, the external dimensions in plan view of the transparent upper part being greater than those of the lower part, the upper part of the case having on its periphery a rim which is supported on the support.

The case may contain a watch movement or a compass. The indices of the dial may form an integral part of the upper part of the case.

The invention will be better understood by reference to the following description, given by way of example, and to the drawings, wherein.

In order to give a good representation of the elements of the assembly, the different elements of the assembly have been intentionally shown on scales which vary from one Figure to another.

Figure 1:
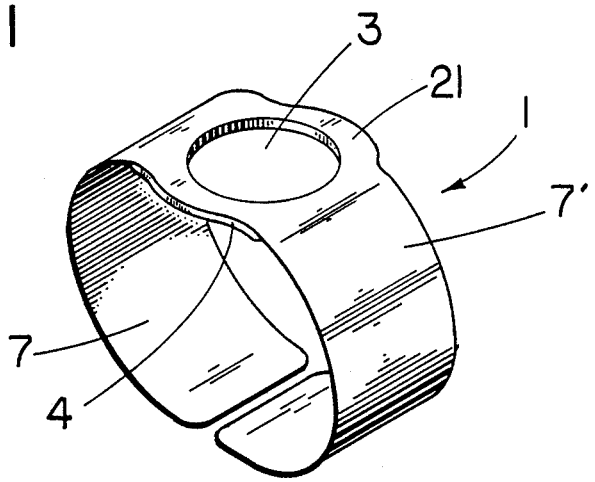
FIG. 1 is a perspective view of an example of a support of the assembly, made in the form of a bracelet.
Figure 2:
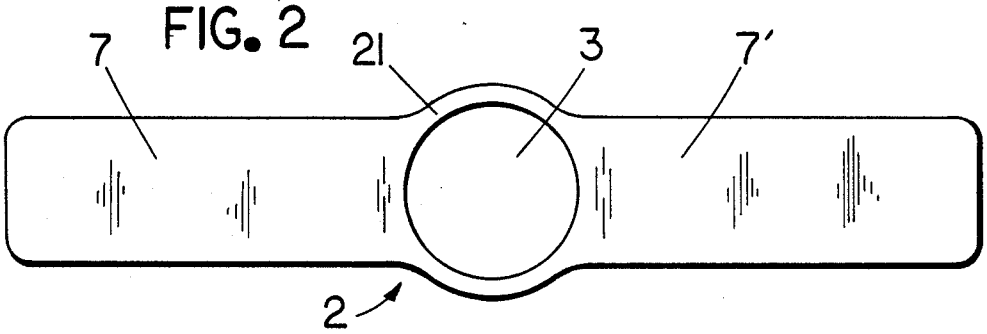
FIG. 2 is a plan view of the base element of the bracelet of FIG. 1, before bending.
Figure 3:
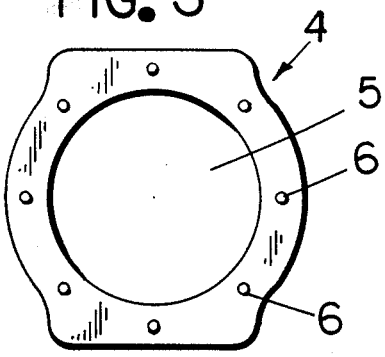
FIG. 3 is an underneath plan view of the ring element of the bracelet of FIG. 1, before being soldered on to the base element shown in FIG. 2.
Figure 4:
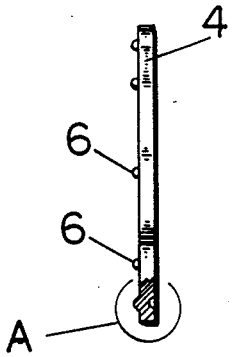
FIG. 4 is a side view, partly in section, of the ring element shown in FIG. 3.
Figure 5:
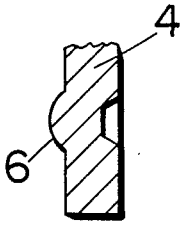
FIG. 5 represents a detail of the part A of FIG. 4.

FIG. 1 represents a bracelet 1 which constitutes a first embodiment of the support for the assembly. The bracelet 1 is formed of a unit consisting of stainless steel, for example, of special spring steel, permitting an adjustment to the wrist without closure. It comprises a base element 2, shown in FIG. 2, obtained by being cut out from a thin steel sheet, and has a circular hole 3 at its centre, which is intended for receiving a case. A ring 4 is spot-welded on the base element of the bracelet. This ring 4, which is shown in FIGS. 3 to 5, is of a thickness greater than that of the base element. At its centre, it has a hole 5 of the same diameter as that of the base element. On one of its faces, the said ring has a plurality of rounded projections 6 produced by stamping and spaced regularly around the hole 5. The spot welding of the ring to the base element of the bracelet is effected at right-angles to these projections. The lateral parts 7, 7' of the base element of the bracelet are then bent to form the curvature which is shown in FIG. 1. After individual finishing, this bracelet is suitable for all wrists.

Figure 9:
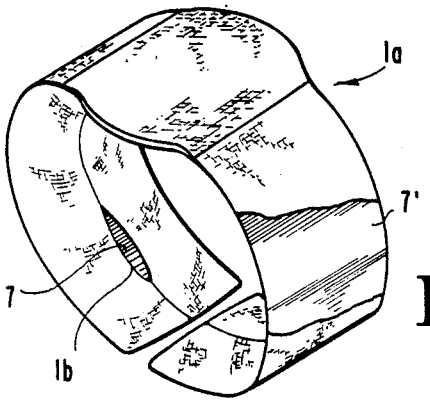
FIG. 9 is a perspective and partially sectioned view of the support of the assembly of FIG. 1 covered with an interchangeable sheath of elastic fabric.

The bracelet is covered with an elongated sheath 13 (FIG. 9) consisting of an elastic fabric. This sheath completely covers the bracelet, including the central hole of the latter. It is removable and replaceable. It is in fact provided with an invisible button-hole 1*b* close to one of its ends. This button-hole permits the bracelet to be introduced into the sheath by introducing the end of one of the lateral parts 7, 7' of the bracelet into the button-hole of the sheath. A wide choice of sheaths of elastic fabric of various colours and various qualities, having a variety of patterns, may be proposed, in order to permit the watch to be adapted to the liking or the clothing of the person who is wearing it.

Figure 6:
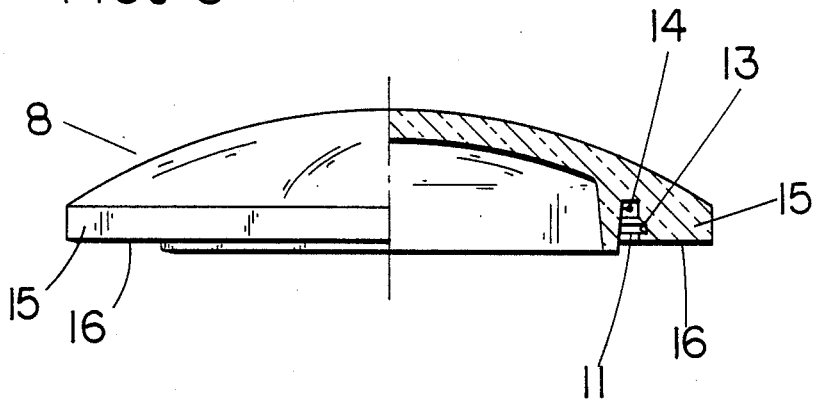
FIG. 6 is a side view, partly in diametral section, of the upper part of a casing example for the assembly of the invention.
Figure 7:
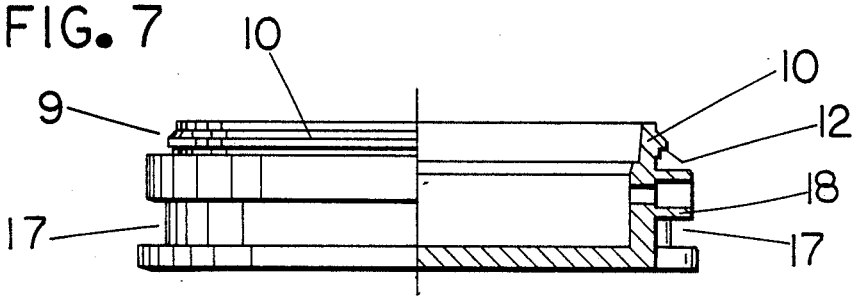
FIG. 7 is a side view, partly in diametral section, of the lower part of the case shown in FIG. 6.
Figure 8:
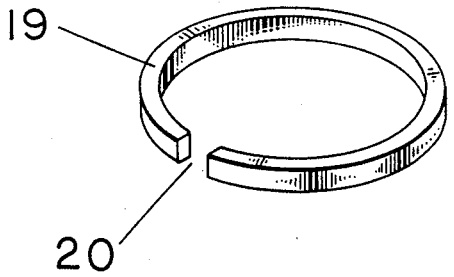
FIG. 8 represents a tension ring used as means for retaining the case on the support.

The case which is shown in FIGS. 6 and 7 is of generally cylindrical form and may be made of plastic material. It comprises a transparent upper part 8, which forms the glass, and a lower part 9, which may contain a watch movement. The lower part 9 comprises an upper ring 10, designed so as to be able to be fitted into a groove 11 which is formed in the base of the upper part 8 over its entire circumference. The ring 10 and the groove 11 are arranged in a manner for assuring the closure of the case. To this end, the ring 10 has an external flange 12 which is designed to cooperate with an internal flange 13 of the groove 11, for maintaining the case in a closed position after the ring 10 has been introduced by pressure into the groove 11. In order to ensure the tightness of the case, a rubber O-ring joint 14 is disposed in the base of the groove 11. The upper part 8 of the case, of which the upper surface is rounded, comprises a projecting part 15, of which the external diameter is larger than the external diameter of the lower part 9 of the case. This projecting part 15 has a lower flat rim 16. The lower part 9 of the case comprises a lateral groove 17 on its circumference, situated at the level of the winder, in order to limit the thickness of the case. A tension ring 19, shown in FIG. 8, is placed in the lateral groove 17 of the lower part of the case. This tension ring comprises a transverse slot 20, the edges of which are disposed on either side of the space 18 of the winder. In the rest position, the external diameter of the tension ring is substantially larger than the internal diameter of the hole 5 of the ring of the bracelet, so as to be held against the lower face of the said ring after the case had been fitted by pressure in the hole of the bracelet. The tension ring 19 may be of steel or a plastic or synthetic material.

The fixing of the case on the bracelet covered with the fabric sheath is effected simply by thumb pressure on the upper surface of the case, the case being positioned against the fabric at right-angles with the hole 3 of the bracelet. When it is desired to remove the case in order to change the material or fabric covering the bracelet, pressure is applied by means of the thumbs to the bottom surface of the case, this pressure being applied through the fabric.

When the case is fixed on the bracelet, the rim 16 of the projecting portion 15 of the upper part of the case comes to bear against the flat surface 21 of the bracelet which surrounds the hole 3. The projecting portion 15 of the upper part of the case being transparent, the fabric which is covering the bracelet and which is situated beneath this projecting part is visible because of the transparency. The aesthetic aspect which is the result thereof also provides a good effect.

Figure 10:
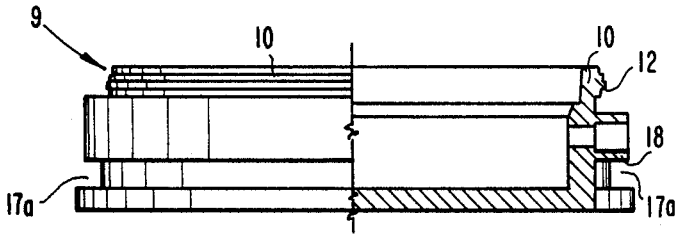
FIG. 10 is a side view, partly in diametral section, of an alternative embodiment of the lower part of the case shown in FIGS. 6 and 7.
Figure 11:
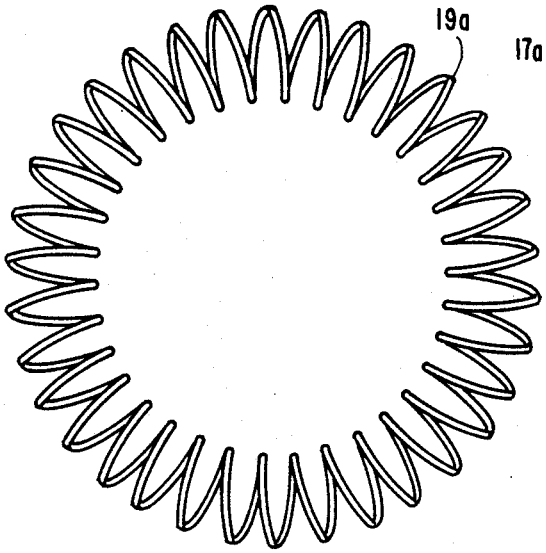
FIG. 11 is an enlarged plan view of a wire spring element used as means for retaining the case shown in FIG. 10 on the support of FIG. 1.

According to a modification (FIGS. 10 and 11) of the assembly, the lateral groove 17*a* of the lower part of the case is situated below the winder frame. In this modified form, the tension ring 19 (FIG. 8) may be replaced by a wire spring element 19*a*, of steel or of a plastic or synthetic material, serving the same function as the ring 19.

In the preferred embodiment of the assembly as described above, the bracelet is made of stainless steel. It is obvious that this bracelet may also be made of any other material, whether or not this material is deformable, and it is possible for the shape of the bracelet to be produced in accordance with numerous variants.

According to a preferred embodiment of the sheaths, these are made of elastic material. It is obvious that any other fabric or synthetic material of small thickness may also be used for the formation of these sheaths, whether or not they are elastic.

Figure 13:
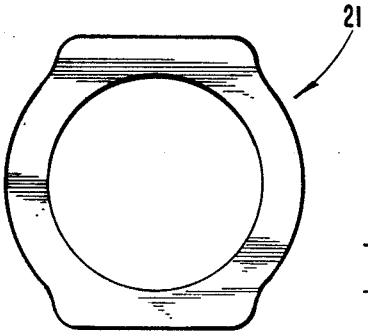
FIG. 13 is an underneath plan view of an alternative embodiment of the support of the assembly, made in the form of an annular element.

In a second embodiment of the support of the assembly (FIG. 13), the support is presented in the form of an annular element 21, for example, a ring of the type such as that shown in FIG. 3, but not stamped. In this case, the assembly may use the same case as that described above, on all the materials or fabrics which are relatively fine, as for example, on a shirt, a pullover, slacks, a blouse, a scarf or any other article of clothing. In order to effect the assembly, it is sufficient to place the ring on one side of the material, the case being placed on the other side, and to introduce the case into the hole of the ring, by applying pressure with the thumbs on the upper surface of the case, the ring being held by two other fingers. This assembly makes it possible to provide a watch which can be clipped on anywhere.

Figure 12:
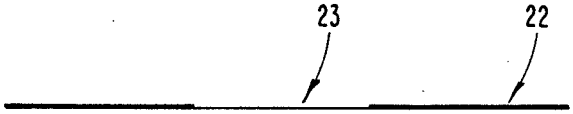
FIG. 12 represents the side view of an alternative support of the assembly of the present invention, having a zone of smaller thickness at the position for the fixing of the case.

In accordance with a modified form of this second embodiment of the assembly (FIG. 12), the assembly can be carried out on any piece of material 22, for example, on a piece of stretchable towelling, having a portion of, lesser thickness 23 at the place for fixing the case on the fixing ring (FIG. 12). Since the piece of material is stretchable, it thus become possible to form a bracelet watch adaptable to any wrist.

The possibilities of establishing the assembly according to the invention are numerous and varied, since the assembly can be achieved on any kind of material, whether such material constitutes an article of clothing or has some other function. The assembly can be carried out anywhere on this material without any particular arrangement of the material at the place where it is desired to effect the assembly. By its conception, the assembly according to the invention does not damage the fabrics on which it is effected and does not leave any trace on the fabric when it is removed.

What is claimed is:

1. An assembly comprising a case (8, 9) fixed on a support (1), characterized in that the case and the support comprise cooperation holding means (3, 19) for assuring a detachable fixing of the case on the support, the support being provided in the form of a rigid bracelet (1), having a flat part (21) comprising an opening (3) into which the case is detachably fixable, the bracelet, including said opening, being first completely covered with a removable and interchangeable sheath (**1*a***) made of an elastic fabric or a thin synthetic or natural elastic material, such that the sheath is interposed between the case and the opening as the case is detachably fixed therein.

2. An assembly according to claim 1, characterized in that the means for holding the case on the bracelet comprise a tension element (19) of steel or of plastic or synthetic material, disposed in a groove (17) provided on the periphery of the case and of which the diameter, in the rest position, is substantially greater than the internal diameter of the opening of the bracelet, so as to be held against the bracelet after the case had been fitted by pressure in the opening of the bracelet.

3. An assembly according to claim 2, characterized in that said case has a winder (18), and the tension element is a tension ring (19) and is disposed in a groove (17) provided on the periphery of the case at the level of the winder, the tension ring comprising a slot (20), the sides of which are situated on both sides of the winder.

4. An assembly according to claim 3, characterized in that the case is of plastic material and comprises a lower part (9) and an upper part (8), the upper part forming the glass and the lower part the casing, the external dimensions in plan view of the transparent upper part being larger than those of the lower part, the upper part of the case having, on its periphery, a rim (16) which bears on the support.

5. An assembly according to claim 4, characterized in that the case contains a watch movement.

6. An assembly according to claim 5, characterized in that the bracelet is formed of a deformable material, permitting an adjustment to the wrist without closure.

7. An assembly according to claim 6, characterized in that the bracelet comprises a ring element (4) spot-welded beneath the flat part (21) of the bracelet.

8. An assembly according to claim 7, characterized in that the bracelet is of special spring steel.

9. An assembly according to claim 7, characterized in that the interchangeable sheath covering the bracelet is of elastic fabric.

10. An assembly according to claim 5, characterized in that the indices of the dial or face form an integral part of the upper part of the case.

11. An assembly according to claim 4, characterized in that the case contains a compass.

12. An assembly according to claim 2, characterized in that the tension element is a wire spring element (**19*a*) and is disposed in a groove (17*a*) provided on the periphery of the case beneath the winder (18**).

13. An assembly according to claim 12, characterized in that the case is of plastic material and comprises a lower part (9) and an upper part (8), the upper part forming the glass and the lower part the casing, the external dimensions in plan view of the transparent upper part being larger than those of the lower part, the upper part of the case having, on its periphery, a rim (16) which bears on the support.

14. An assembly according to claim 13, characterized in that the case contains a watch movement.

15. An assembly comprising a case (8 , 9) fixed on a support (1), characterized in that the case and the support comprise cooperating holding means (3, 19) for assuring a detachable fixing of the case on the support, said support being presented in the form of an annular element, the said holding means being designed to permit the interposition of a fabric or thin synthetic or natural material between the case and the annular element and being further characterized in that the means for holding the case on the annular element comprise a tension element (19) of steel or of plastic or synthetic material, disposed in a groove (17) provided on the periphery of the case and of which the diameter, in the rest position, is substantially greater than the internal diameter of the annular element, so as to be held against the annular element after the case had been fitted by pressure in the opening of the annular element.

16. An assembly according to claim 15, characterized in that said case has a winder (18), and the tension element is a tension ring (19) and is disposed in a groove (17) provided on the periphery of the case at the level of the winder, the tension ring comprising a slot (20), the sides of which are situated on both sides of the winder.

17. An assembly according to claim 16, characterized in that the case is of plastic material and comprises a lower part (9) and an upper part (8), the upper part forming the glass and the lower part the casing, the external dimensions in plan view of the transparent upper part being larger than those of the lower part, the upper part of the case having, on its periphery, a rim (16) which bears on the support.

18. An assembly according to claim 17, characterized in that the case contains a watch movement.

19. An assembly according to claim 18, characterized in that it is carried out on an article of clothing.

20. An assembly according to claim 18, characterized in that it is carried out on an elastic material (22), comprising a zone of smaller thickness (23) at the position where the case is fixed on the annular element.

21. An assembly according to claim 17, characterized in that the case contains a compass.

22. An assembly according to claim 15, characterized in that the tension element is a wire spring element (**19*a*) and is disposed in a groove (17*a*) provided on the periphery of the case beneath the winder (18**).

* * * * *

UNITED STATES PATENT AND TRADEMARK OFFICE

CERTIFICATE OF CORRECTION

PATENT NO. : 4,958,279

DATED : September 18, 1990

INVENTOR(S) : Francois Proellochs

It is certified that error appears in the above-identified patent and that said Letters Patent is hereby corrected as shown below:

In column 3, line 32, please change the numerals "13" to --1a--.

Signed and Sealed this

Seventh Day of January, 1992

*Attest:*

HARRY F. MANBECK, JR.

*Attesting Officer*

*Commissioner of Patents and Trademarks*